US005664852A

United States Patent [19]

Robinson

[11] Patent Number: 5,664,852

[45] Date of Patent: Sep. 9, 1997

[54] HANDICAPPED VANITY

[76] Inventor: Sarah S. Robinson, 16996 Marguerite, Beverly Hills, Mich. 48025

[21] Appl. No.: 629,961

[22] Filed: Apr. 21, 1996

[51] Int. Cl.[6] ..... A47B 77/06

[52] U.S. Cl. ..... 312/228; 312/140.4; 312/197; 312/270.2; 312/249.2; 312/239

[58] Field of Search ..... 312/140.1, 140.4, 312/197, 194, 204, 228, 270.2, 270.3, 249.2, 249.7, 239, 321.5, 326

[56] References Cited

U.S. PATENT DOCUMENTS

| | | | |
|---|---|---|---|
| 186,143 | 1/1877 | Mar . | |
| 323,970 | 8/1885 | Stryker . | |
| 349,875 | 9/1886 | Crocker . | |
| 481,848 | 8/1892 | Couillard . | |
| 654,922 | 7/1900 | Schipkowsky | 312/197 X |
| 952,624 | 3/1910 | Mothersill . | |
| 1,269,225 | 6/1918 | Sciannamea | 312/197 |
| 1,688,456 | 10/1928 | Dolph | 312/197 |
| 2,710,242 | 6/1955 | Chase | 312/329 |
| 2,867,488 | 1/1959 | Guild | 312/228 X |
| 3,075,820 | 1/1963 | Humphrey | 312/326 |
| 3,101,227 | 8/1963 | Pugh | 312/326 |
| 3,160,453 | 12/1964 | Tassell | 312/326 |
| 4,002,382 | 1/1977 | Wolf et al. | 312/228 X |

*Primary Examiner*—Peter M. Cuomo
*Assistant Examiner*—Stephen Vu
*Attorney, Agent, or Firm*—Young & Basile, P.C.

[57] ABSTRACT

A handicapped vanity of the type including a counter and a sink positioned in the counter. The vanity further includes left and right cabinets positioned beneath the counter proximate the sink and each mounted for pivotal movement between a storage position in which a storage portion of the cabinet is positioned beneath the counter and an access position in which the storage portion is positioned forwardly of the counter on a respective side of the centerline of the sink. Each cabinet further includes an impact portion positioned directly beneath the sink in the path of movement of an approaching wheelchair so that the approaching wheelchair strikes the impact portions of the cabinets and pivots the storage portions of the cabinets to their access positions on opposite sides of the wheelchair.

11 Claims, 3 Drawing Sheets

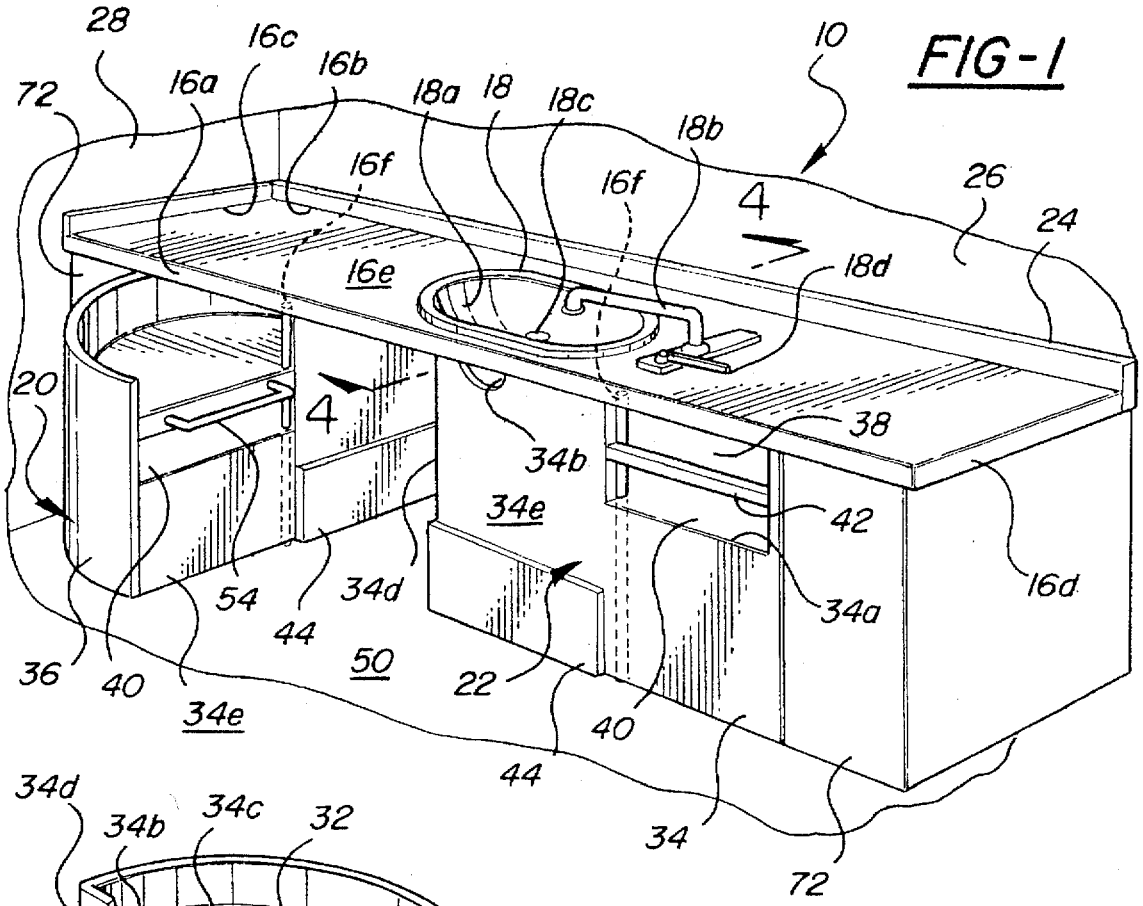
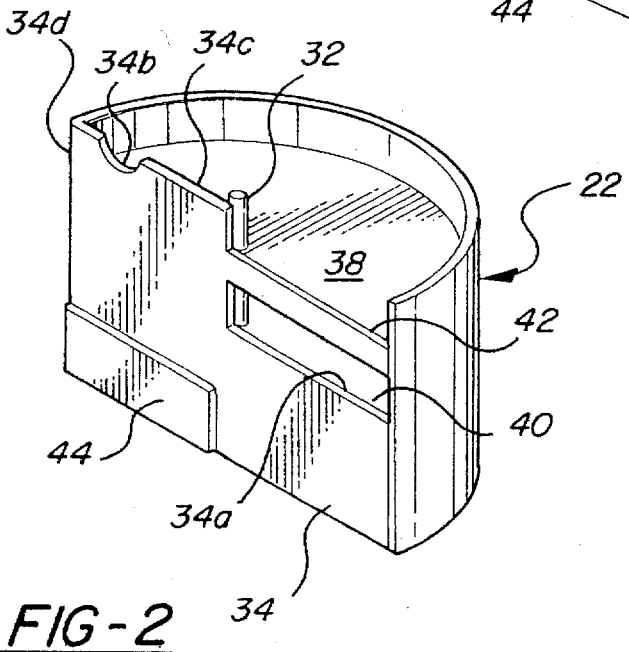
FIG-2
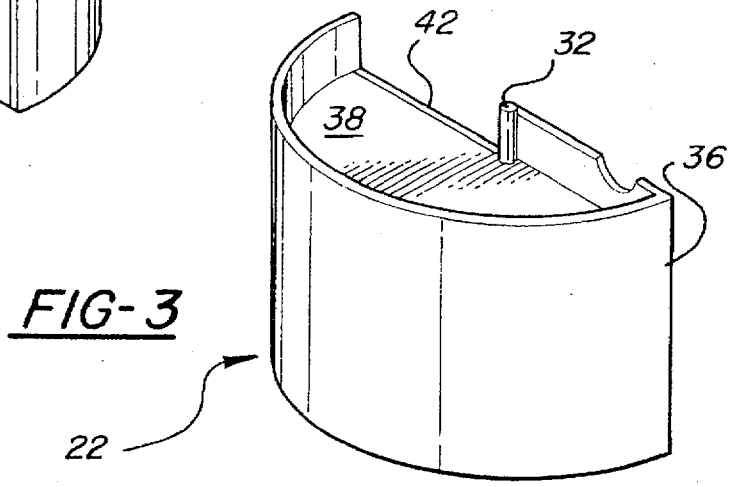
FIG-3

HANDICAPPED VANITY

BACKGROUND OF THE INVENTION

This invention relates to vanities and more particularly to vanities that are especially constructed and equipped to facilitate access to the vanity by a handicapped person.

Paraplegics (individuals suffering motor and sensory paralysis of the entire lower half of the body) are typically confined to wheelchairs and therefore rely on wheelchairs for their mobility. Access of wheelchair confined individuals to various stations is always difficult and is especially difficult with respect to access to vanities since access to the vanity typically involves access to toiletries and grooming aids for use in cleaning and grooming. Specifically, the toiletries and grooming aids associated with a vanity are typically housed in medicine cabinets or in other difficult to access drawers in the vicinity of the vanity, thereby complicating the process of accessing the vanity and performing the required cleaning and grooming operations.

SUMMARY OF THE INVENTION

This invention relates to a vanity especially suitable for use by handicapped individuals.

The invention vanity is of the type including a counter and a sink positioned in the counter. According to the invention, the vanity further includes a moveable cabinet having an impact portion and a storage portion and means operative in response to impact of an approaching wheelchair or occupant with the impact portion to move the cabinet from a storage position in which the storage portion is positioned beneath the counter to an access position in which the storage portion is positioned forwardly of the counter. This arrangement allows the approaching wheelchair or occupant to automatically move the storage portion of the cabinet to a position forwardly of the cabinet where toiletries and grooming aids carried by the storage portion may be readily accessed by the wheelchair bound individual.

According to a further feature of the invention, the operative means includes means mounting the cabinet for pivotal movement between the storage and access positions and, with the cabinet in its storage position, the impact portion of the cabinet is positioned beneath the sink in the path of movement of a wheelchair accessing the sink. This specific arrangement facilitates the movement of the cabinet to its access position under the impetus of the approaching wheelchair.

According to a further feature of the invention, the vanity defines a centerline passing through the sink and extending generally perpendicular to the front edge of the counter; the cabinet comprises a first cabinet; with the first cabinet in its access position the storage portion of the first cabinet is positioned forwardly of the counter on one side of the centerline; and the vanity further includes a second cabinet having an impact portion and a storage portion and mounted for movement between a storage position in which the storage portion is positioned beneath the counter and an access position in which the storage portion is positioned forwardly of the counter on the other side of the centerline. With this arrangement, the first and second cabinets may assume access positions on opposite sides of the wheelchair whereby to provide ready access to either cabinet by the wheelchair bound individual.

According to a further feature of the invention, each cabinet defines a planar face portion which is positioned, with the cabinet in its storage position, generally beneath the sink, generally normal to the centerline of the sink, and on a respective side of the centerline, and the planar face portion of each cabinet constitutes the portion of the cabinet that is impacted by the approaching wheelchair.

A further novel combination of the invention comprises a counter having a front edge; a sink positioned in the counter and defining a centerline normal to the counter front edge; a first cabinet having a storage portion and mounted for movement between a storage position in which the storage portion is positioned beneath the counter and an access position in which the storage portion is positioned forwardly of the counter on one side of the centerline; and a second cabinet having a storage portion and mounted for movement between a storage position in which the storage portion is positioned beneath the counter and an access position in which the storage portion is positioned forwardly of the counter on the other side of the centerline. In the disclosed embodiment of the invention, the cabinet storage portions are separated in their access positions by a distance sufficient to allow placement of a wheelchair therebetween. This arrangement facilitates access of the wheelchair bound individual to the toiletry items necessary to perform the cleaning and grooming operations associated with accessing the vanity.

BRIEF DESCRIPTION OF THE DRAWINGS

FIG. 1 is a perspective view of a handicapped vanity according to the invention;

FIGS. 2 and 3 are front and rear perspective views, respectively, of a cabinet utilized in the vanity;

DETAILED DESCRIPTION OF THE PREFERRED EMBODIMENT

Figure 5:
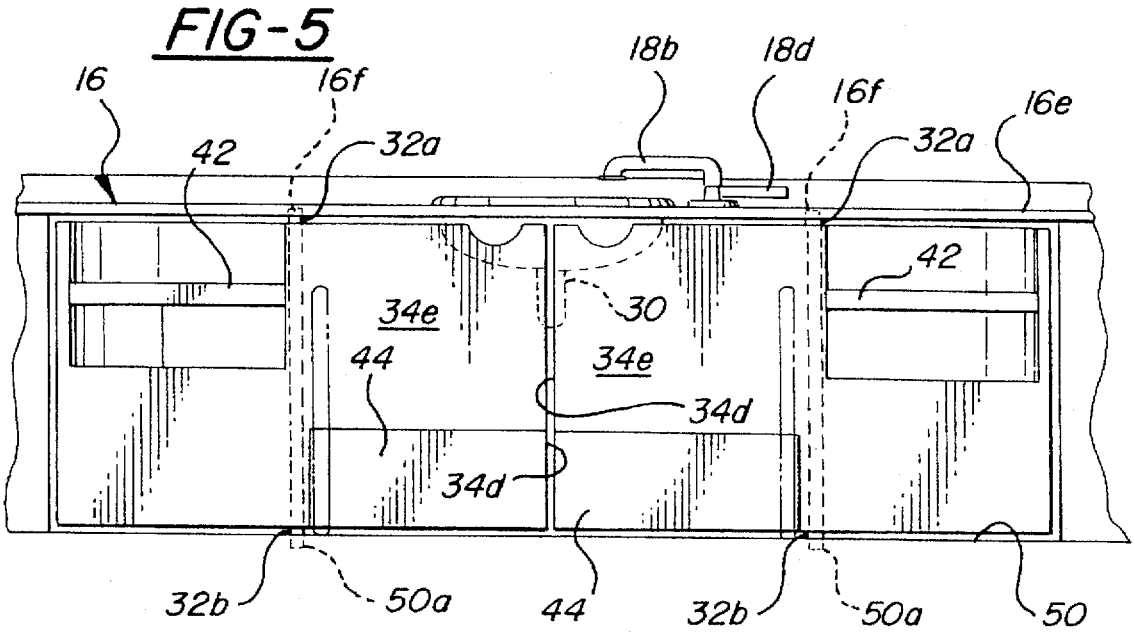
FIG. 5 is a front view of the vanity.

The vanity 10 of the invention is specially suited to facilitate access to the vanity and to the associated toiletry and grooming items by an individual 12 confined to a wheelchair 14.

The vanity 10, broadly considered, includes a counter 16, a sink 18, and a pair of left and right cabinets 20, 22.

Counter 16 is of known form and includes a front edge 16*a*, a rear edge 16*b*, and end edges 16*c*, and 16*d*. A splash board 24 may be provided at the interface of the counter with the walls 26, 28 of the associated room.

Sink 18 is of known form and is suitably recessed in the top face 16*e* of the counter. Sink 18 includes a bowl 18*a*, a faucet 18*b*, a drain 18*c*, and a handle 18*d* which may be oversized to facilitate use by handicapped individuals. A gooseneck drainage system 30 associated with the drain 18*d* provides drainage for the sink 18 in known manner.

Each cabinet 20, 22 has a generally semi-circular configuration and includes a central pivot shaft 32, a planar front face 34, a semi-circular rear panel 36, and semi-circular upper and lower shelves 38, 40. Pivot shaft 32 is vertically oriented and is suitably secured to the rear face,of front panel 34 midway between the ends of the panel. Front panel 34 is cut away at 34*a* to provide access to the shelves 38, 40 at one side of the pivot shaft 32. A ledge 42 is provided at the exposed front edge of the upper shelf 38 to preclude toiletries placed on the ledge from falling off of the ledge. The upper edge of cutout 34*a* of the front panel extends above the level of lower shelf 40 to provide a similar ledge effect for the shelf 40. A hand cutout 34*b* is provided in the upper edge 34*c* of the front panel 34 on the side of pivot shaft 32 opposite cutout 34*a* and a kick plate 44, formed of stainless steel or the like, is suitably secured to the front lower face of panel 34 on the side of pivot shaft 32 opposite cutout 34*a*.

Figure 6:
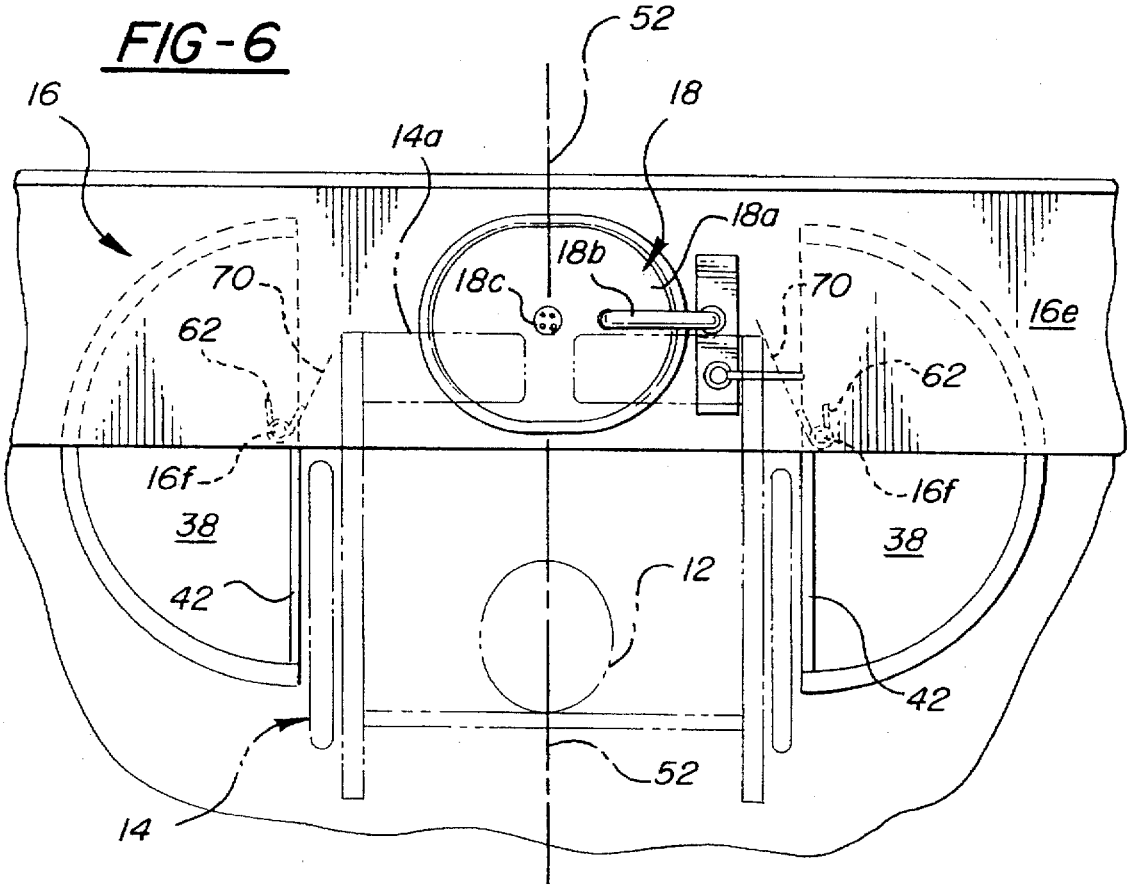
FIG. 6 is a top view of the vanity.
Figure 4:
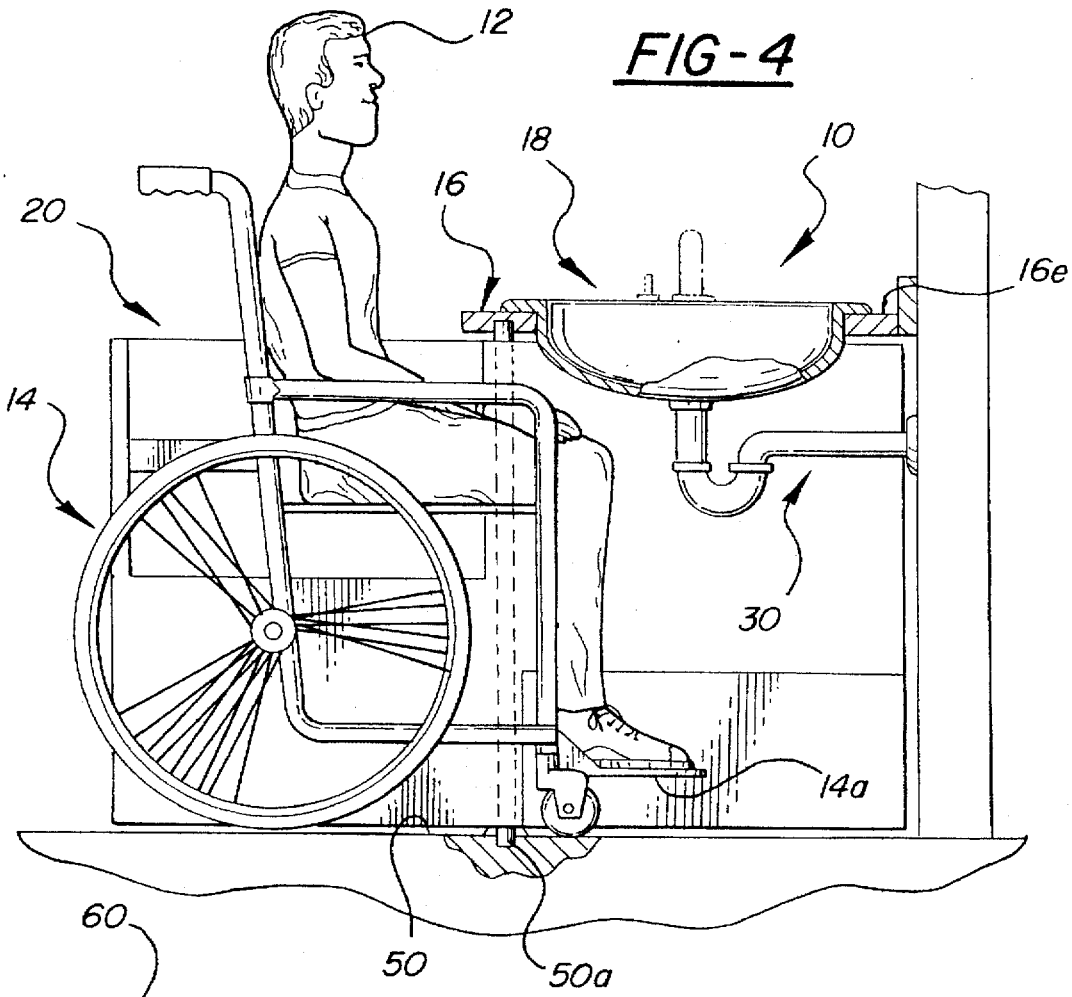
FIG. 4 is a cross-sectional view taken on line 4—4 of FIG. 1.

Cabinets 20, 22 are identical except as to hand and are installed in side-by-side relation beneath the counter 16 with the upper end 32*a* of each pivot shaft suitably journaled in a socket 16*f* in the lower front face of the counter and the lower end 32*b* of each pivot shaft suitably journaled in a socket 50*a* in the support surface or floor 50 of the associated room. The cabinets are thus mounted for pivotal movement between a storage position beneath the counter and an access position in which the outboard or storage portion of the cabinet is positioned forwardly of the counter. The cabinets are seen in their storage positions in FIG. 5 and in their access positions in FIG. 6. In FIGS. 1 and 4 (for illustrative purposes only) the left cabinet is shown in its access position and the right cabinet is shown in its storage position.

When positioned beneath the counter in their storage positions, the respective vertical inboard edges 34*d* of the left and right cabinets are positioned adjacent each other and proximate the sink centerline 52 with the front faces 34*e* of the front panels 34 in alignment with each other and positioned parallel to but slightly rearwardly of the front edge 16*a* of the counter. Each cabinet thus presents an inboard impact portion on the inboard side of the cabinet directly beneath the sink and including a respective strike plate 44, and an outboard storage portion on the outboard side of the cabinet remote from the sink.

Figure 7:
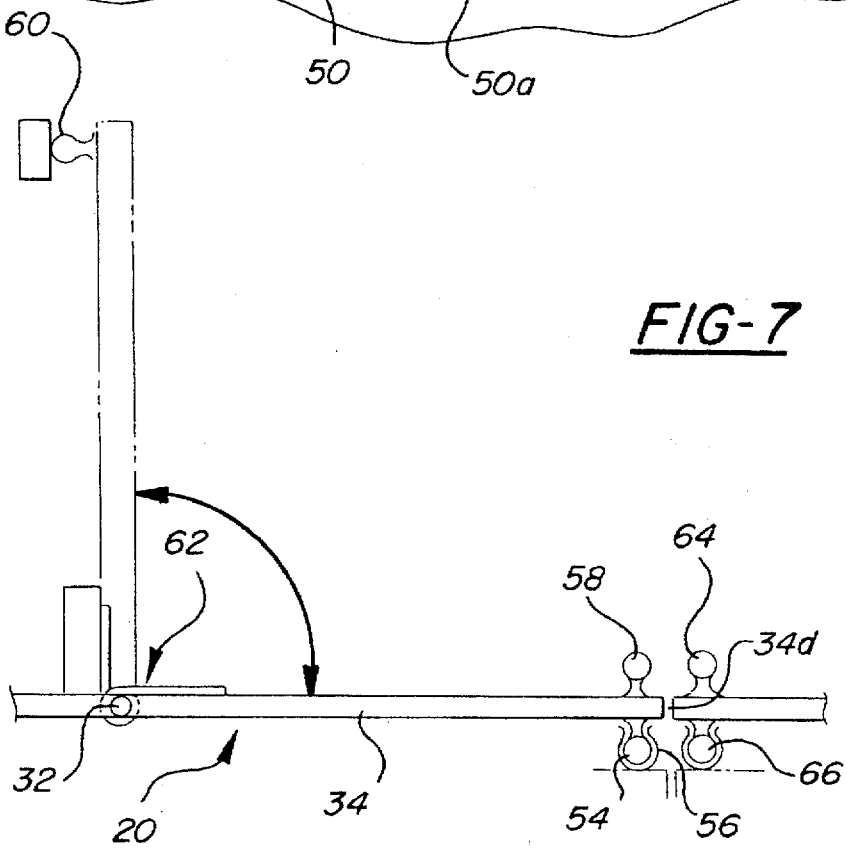
FIG. 7 is a fragmentary view showing various details of the vanity.

As seen schematically in FIG. 7, left cabinet 20 is mounted for counterclockwise pivotal movement about its pivot shaft 32 through essentially 90° from its storage position, in which a knob 54 suitably positioned on the front panel 34 of the cabinet proximate inboard edge 34*d* engages a spring clip 56 suitably positioned on a portion of the general vanity structure, and its access position, in which a knob 58 on an opposite face of the panel 34 engages a spring clip 60 suitably positioned on a portion of the general vanity structure. The movement of the cabinet between storage and access positions is resisted by a coil spring 62 so that the cabinet is at all times spring biased in a clockwise direction towards its storage position.

Similarly, right cabinet 22 is mounted for clockwise pivotal movement about its pivot shaft 32 between its storage and access positions with the respective positions being defined and delimited by knobs 64, 66 proximate inboard edge 34*d* coacting with spring clips suitably positioned on the general vanity structure and with a spring 62 continuously biasing the cabinet in a counterclockwise direction toward its storage position. The cabinets thus normally assume their storage positions and are releasably maintained in their storage positions by the coaction of knobs 54, 66 and their associated spring clips.

In the use of the invention handicapped vanity, as the wheelchair 14 carrying the paraplegic 12 approaches the vanity to access the sink, the footrest portions 14*a* and/or the feet of the occupant 12 impact against the strike plates 44 and cause the knobs 54 and 66 to release from their associated spring clips and cause the cabinets to rotate respectively clockwise and counterclockwise about their pivot axes toward their open or access positions. Depending on the parameters of the individual installation, the system may be designed such that the momentum imparted to the cabinets by the impacting wheelchair is sufficient to cause the cabinets to move against the bias of springs 62 to their fully open or access positions in which the knobs 58, 64 latchingly engage with the associated spring clips or, alternatively, the installation parameters may be chosen such that the cabinets move only so far as they can be physically moved by the wheelchair (such as to the dash line positions 70 seen in FIG. 6), whereafter the occupant 12 utilizing, for example, the ledges 42, pulls the cabinets the rest of the way to their access positions as established by engagement of knobs 58, 64 with the associated spring latches.

In the fully open or access positions, the front panels 34 are positioned on opposite sides of the centerline 52 and parallel to the centerline and are spaced apart by a distance (such for example as 32") sufficient to allow ready and convenient access by a wheelchair. Once the cabinets have been moved to their access positions, the occupant 12 may readily access toiletries and grooming aids positioned on the shelves 38, 40 of both cabinets to perform the required or desired cleansing and grooming operations. Once the cleansing and grooming operations have been completed, the occupant 12 may propel the wheelchair backwardly from the vanity to a point where the wheelchair is withdrawn from beneath the counter whereafter the occupant may simply lightly push outwardly on each cabinet to break the frictional engagement between the knobs 58, 64 and the associated spring clips and allow the cabinets to return to their storage positions under the force of springs 62 with the knobs 54 and 66 engaging the associated spring clips as the cabinets return to their storage position beneath the sink to delimit and define these positions.

It will be noted that, in addition to the storage area provided immediately adjacent the occupant 12 by the shelves 38, 40 for the convenience of the paraplegic occupant, the disclosed structure further provides storage areas on the shelves 38, 40 behind the impact portion of the front panel 34. This additional storage area, while difficult for the paraplegic occupant 12 to access, may be used by other members of the family for storage purposes. In this regard it should be noted that the invention handicapped vanity, while especially suitable for use by paraplegic, wheelchair bound individuals, is also readily usable by able-bodied family members who may use the vanity either with the cabinets in the storage positions, in which case the toiletries are readily accessed through the openings in the front face of the cabinets providing access to the shelves 38 and 40, or by pivoting the cabinets to their access positions to provide better access to the toiletries positioned on the shelves 38 and 40 and/or access to articles stored behind the panels 34 beneath the counter. Hand cutouts 34*b* facilitate the movement of the cabinets between the access and storage positions and a towel rack 54 may also be provided on one or more of the ledges 42 to provide ready access to a towel for the handicapped individual and/or to provide a further handle means to move the cabinets between their access and storage positions. Depending on the installation, the vanity may also include fixed, vertical side panels 72 on either side of the swinging cabinets to extend the vanity to the side walls of the associated room.

Whereas a preferred embodiment of the invention has been illustrated and described in detail, it will be apparent that various changes may be made in the disclosed embodiment without departing from the scope or spirit of the invention.

I claim:

1. A handicapped vanity comprising:

a counter having a front edge;

a sink positioned in the counter;

a cabinet having an impact portion and a storage portion and mounted for movement between a storage position in which the storage portion is positioned beneath the counter and the impact portion is positioned beneath the counter directly forwardly of the sink in a position blocking access to a space under the counter beneath the sink and an access position in which the storage portion extends forwardly from the front edge of the counter and the impact portion is positioned beneath the counter in a position allowing entry of a leading edge of a wheelchair into the space; and means operative in response to impact of an approaching wheelchair or occupant with the impact portion to move the cabinet from said storage position to said access position whereby a leading edge of the wheelchair may enter the space and the storage portion of the cabinet extends forwardly from the front edge of the counter and alongside the wheelchair for access by the wheelchair occupant.

2. A handicapped vanity according to claim 1 wherein the operative means includes means mounting the cabinets for pivotal movement between the storage and access positions.

3. A handicapped vanity according to claim 1 wherein:

the vanity defines a center line passing through the sink and extending generally perpendicular to the front edge of the counter;

the cabinet comprises a first cabinet;

with the first cabinet in said access position the storage portion of the first cabinet is positioned forwardly of the counter on one side of the center line and the impact portion of the first cabinet is positioned beneath the counter in a position allowing entry of a leading edge of a wheelchair into the space;

the vanity further includes a second cabinet having an impact portion and a storage portion, and mounted for movement between a storage position in which the storage portion is positioned beneath the counter and the impact portion is positioned beneath the counter directly forwardly of the sink in a position blocking access to the space and an access position in which the storage portion extends forwardly from the front edge of the counter on the other side of the center line and the impact portion is positioned beneath the counter in a position allowing entry of a leading edge of a wheelchair into the space.

4. A handicapped vanity comprising:

a counter having a front edge;

a sink positioned in the counter;

first and second cabinets each having an impact portion and a storage portion and each mounted for movement between a storage position in which the storage portion is positioned beneath the counter and the impact portion is positioned beneath the counter directly forwardly of the sink in a position blocking access to a space under the counter beneath the sink and an access position in which the storage portion extends forwardly from the front edge of the counter and the impact portion is positioned beneath the counter in a position allowing entry of a leading edge of a wheelchair into the space; and means operative in response to impact of an approaching wheelchair or occupant with the impact portions to move the cabinets from said storage positions to said access positions whereby a leading edge of the wheelchair may enter the space and the storage portions of the first and second cabinets extend forwardly from the front edge of the counter for access by the wheelchair occupant.

5. A handicapped vanity according to claim 4 wherein the operative means includes means mounting the cabinets for pivotal movement between the storage and access positions.

6. A handicapped vanity according to claims 4 wherein:

the vanity defines a center line passing through the sink and extending perpendicular to the front edge of the counter; and the first and second cabinets are respectively positioned on opposite sides of the center line.

7. A handicapped vanity according to claim 6 wherein:

each cabinet is mounted for pivotal movement between its storage and access positions;

each cabinet defines a planar face portion which is positioned, with the cabinet in its storage position, generally beneath the sink, generally normal to the center line, and on a respective side of the center line; and the planar face portion of each cabinet constitutes the impact portion of the cabinet.

8. A handicapped vanity according to claim 7 wherein the storage portion of each cabinet defines a planar front face which is aligned with the planar face of the impact portion of that cabinet.

9. A handicapped vanity comprising:

a counter having a front edge;

a sink positioned in the counter and defining a center line normal to the counter front edge;

a first cabinet having a storage portion defining a first planar front face and mounted for movement between a storage position in which the storage portion is positioned beneath the counter and an access position in which the storage portion extends forwardly from the front edge of the counter on one side of the center line with the first planar front face extending generally parallel to the center line; and a second cabinet having a storage portion defining a second planar front face and mounted for movement between a storage position in which the storage portion is positioned beneath the counter and an access position in which the storage portion extends forwardly from the front edge of the counter on the other side of the center line with the second planar front face extending generally parallel to the center line and laterally displaced from the first planar front face by a distance sufficient to allow placement of a wheelchair therebetween.

10. A handicapped vanity according to claim 9 wherein the cabinets are mounted for pivotal movement between the storage and access positions.

11. A handicapped vanity according to claim 9 wherein:

each of said cabinets is mounted for pivotal movement about a generally vertical pivot axis;

the storage portion of each of said cabinets is positioned on one side of the pivot axis; and each of said cabinets further includes a planar impact portion positioned on the other side of the pivot axis, lying in the plane of the respective planar front face, and positioned in the path of movement of a wheelchair accessing the sink.

* * * * *